US008118017B2

(12) United States Patent
Lammonds

(10) Patent No.: US 8,118,017 B2
(45) Date of Patent: Feb. 21, 2012

(54) SCENT DISTRIBUTING AIRGUN

(76) Inventor: Timothy R. Lammonds, Mineral, VA (US)

( * ) Notice: Subject to any disclaimer, the term of this patent is extended or adjusted under 35 U.S.C. 154(b) by 0 days.

(21) Appl. No.: 12/700,245

(22) Filed: Feb. 4, 2010

(65) Prior Publication Data

US 2010/0192930 A1 Aug. 5, 2010

Related U.S. Application Data

(60) Provisional application No. 61/114,738, filed on Feb. 4, 2009.

(51) Int. Cl.
*F41B 11/00* (2006.01)

(52) U.S. Cl. ..... 124/74

(58) Field of Classification Search ..... 124/71–77
See application file for complete search history.

(56) References Cited

U.S. PATENT DOCUMENTS

| | | | | | |
|---|---|---|---|---|---|
| 1,545,465 | A | * | 7/1925 | Johnstone et al. | 124/67 |
| 3,302,319 | A | * | 2/1967 | Rosselet | 42/106 |
| 3,726,266 | A | * | 4/1973 | Palmer | 124/59 |
| 3,924,599 | A | * | 12/1975 | Hammond | 124/67 |
| 4,282,852 | A | * | 8/1981 | Omana | 124/67 |
| 4,774,929 | A | * | 10/1988 | Milliman | 124/76 |
| 4,998,368 | A | * | 3/1991 | Blase | 42/95 |
| 5,160,795 | A | * | 11/1992 | Milliman | 42/65 |
| 5,165,383 | A | * | 11/1992 | Ebert et al. | 124/74 |
| 5,225,610 | A | * | 7/1993 | Uria | 42/40 |
| 5,400,536 | A | * | 3/1995 | Milliman | 42/65 |
| 5,404,863 | A | * | 4/1995 | Poor | 124/74 |
| 5,456,036 | A | * | 10/1995 | Butz | 43/1 |
| 5,704,150 | A | * | 1/1998 | Milliman | 42/67 |
| 5,936,190 | A | * | 8/1999 | Buzick | 102/502 |
| 7,506,468 | B2 | * | 3/2009 | Farrell et al. | 42/70.06 |
| 2008/0060248 | A1 | * | 3/2008 | Pine et al. | 42/114 |
| 2010/0175297 | A1 | * | 7/2010 | Speroni | 42/114 |

* cited by examiner

*Primary Examiner* — Troy Chambers
(74) *Attorney, Agent, or Firm* — L.C. Begin & Associates, PLLC.

(57) ABSTRACT

One embodiment of a collapsible scent distributing airgun ("airgun") may include a body and a gas cartridge, which may be carried by the body and contain a pressurized gas. The airgun may also have a pressure regulator valve, which may be carried by the body and communicated with the gas cartridge. In addition, the airgun may also have a barrel that may be pivotally carried by the body and movable between collapsed and extended positions. The barrel in the extended position may have an end communicated with the pressure regulator valve to receive the pressurized gas. Further, the barrel in the collapsed position may have the end adapted to receive a projectile configured to emit a scent. Also, the airgun may have a trigger that may be pivotally carried by the body and coupled to the pressure regulator valve to selectively direct the pressurized gas into the barrel for launching the projectile.

15 Claims, 2 Drawing Sheets

SCENT DISTRIBUTING AIRGUN

CROSS-REFERENCE TO RELATED APPLICATION

This application claims the benefit of U.S. Provisional Application Ser. No. 61/114,738 filed on Feb. 4, 2009, the disclosure of which is incorporated by reference.

FIELD OF THE DISCLOSURE

The present disclosure relates generally to scent distribution devices and methods, and more particularly, to a collapsible scent distributing airgun for hunters.

BACKGROUND OF THE DISCLOSURE

Hunters may enter an area to spray liquid-based animal scent or lures in order to attract game into that area. The scent may include deer musk, bear musk, doe urine, tarsal gland scent, acorn scent and apple scents. The hunters, however, may also leave behind their human scent thereby scaring the game away from the area.

SUMMARY OF THE DISCLOSURE

One embodiment of a collapsible scent distributing airgun ("airgun") may include a body and a gas cartridge, which may be carried by the body and contain a pressurized gas. The airgun may also have a pressure regulator valve, which may be carried by the body and communicated with the gas cartridge. In addition, the airgun may also have a barrel that may be pivotally carried by the body and movable between collapsed and extended positions. The barrel in the extended position may have an end communicated with the pressure regulator valve to receive the pressurized gas. Further, the barrel in the collapsed position may have the end adapted to receive a projectile configured to emit a scent. Also, the airgun may have a trigger that may be pivotally carried by the body and coupled to the pressure regulator valve to selectively direct the pressurized gas into the barrel for launching the projectile.

An embodiment of a method for operating the airgun may include pivoting a barrel of the airgun to a collapsed position. The method may also include inserting a projectile into the barrel. The method may further include pivoting the barrel to an extended position so that the barrel is communicated with a pressure regulator valve of the airgun which is in turn communicated with a gas cartridge of the airgun. In addition, the method may also include operating a trigger coupled to the pressure regulator valve so that the valve may direct a predetermined amount of pressurized gas from the gas cartridge to the barrel for launching the projectile therefrom.

BRIEF DESCRIPTION OF THE DRAWING

The advantages and features of the present disclosure will become better understood with reference to the detailed description taken in conjunction with the accompanying drawings, in which.

Like reference numerals refer to like parts throughout the description of several views of the drawings.

DETAILED DESCRIPTION OF THE DISCLOSURE

Exemplary modes for carrying out the disclosure are presented and depicted in FIGS. 1-7. The exemplary embodiments described herein provide detail for illustrative purposes only and are subject to many variations. It is understood that various omissions and substitutions of equivalents are contemplated as circumstances may suggest or render expedient, but are intended to cover the application or implementation without departing from the spirit or scope of the present disclosure.

Figure 1:
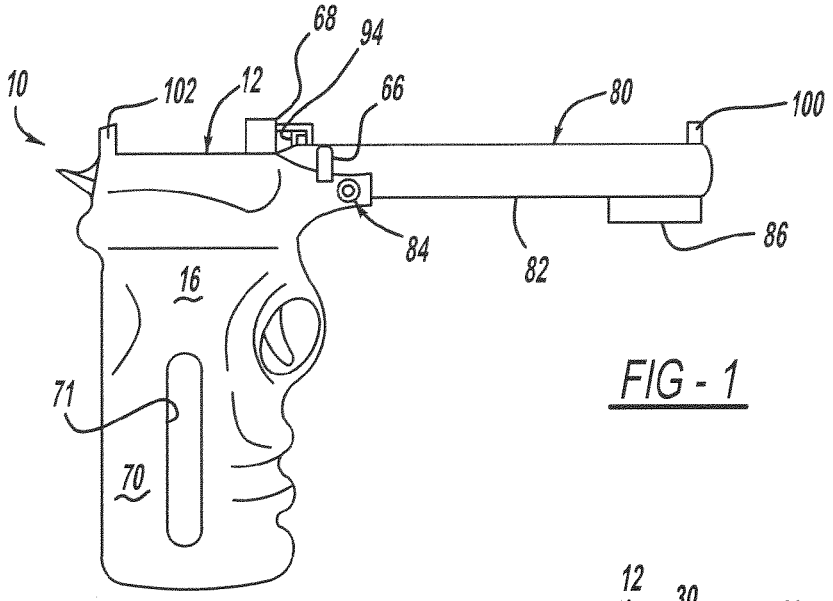
FIG. 1 is a perspective view of one embodiment of a collapsible scent distributing airgun, showing the airgun having a barrel moved to an extended position.
Figure 2:
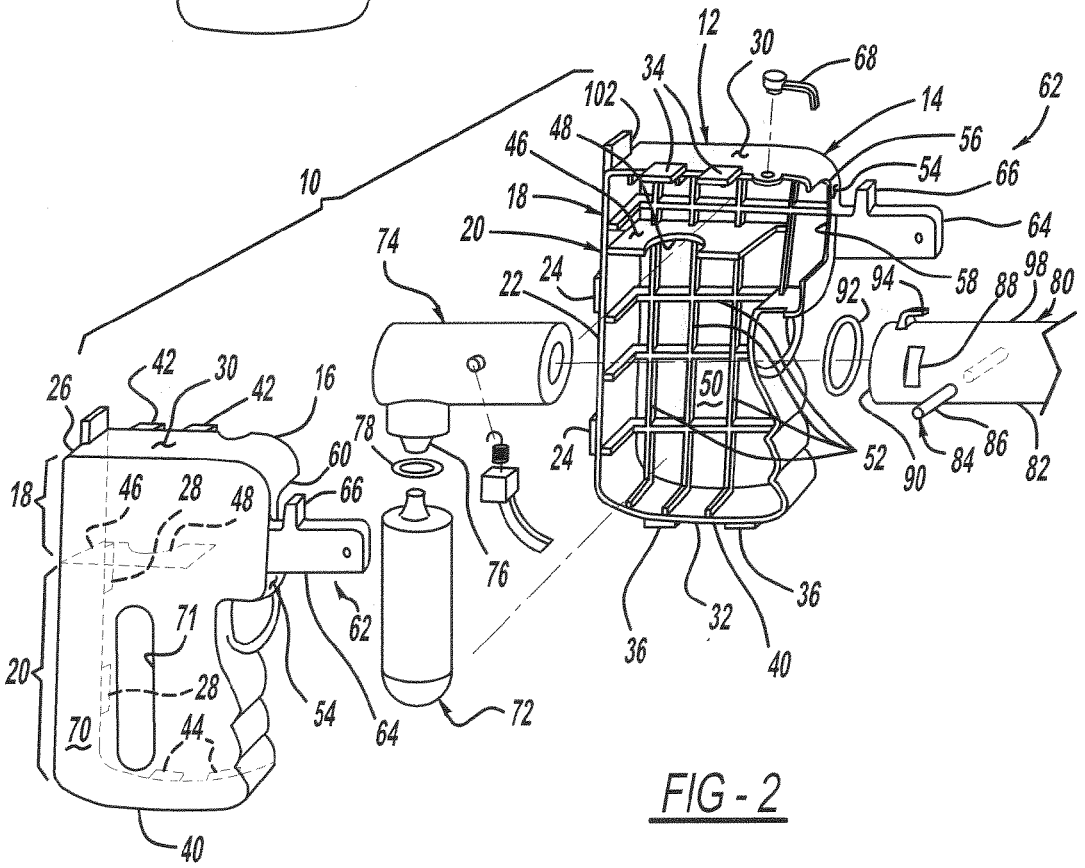
FIG. 2 is an exploded view of the airgun of FIG. 1.
Figure 3:
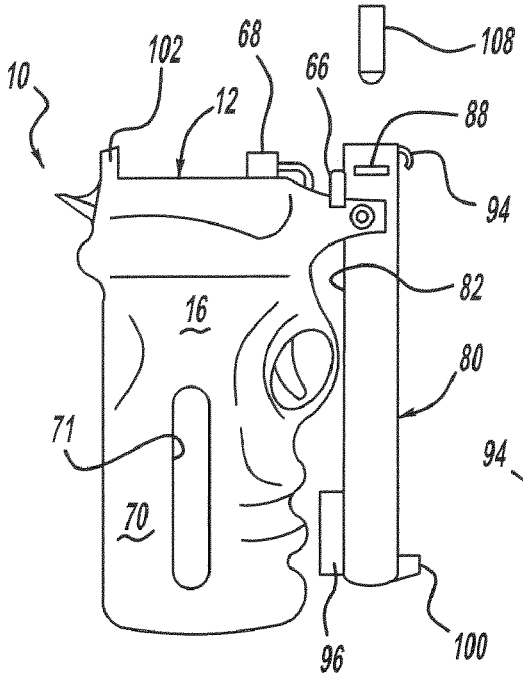
FIG. 3 is another perspective view of the airgun of FIG. 1, showing the barrel moved to a collapsed position to permit a projectile to be loaded into the barrel.

Referring to FIGS. 1-3, one embodiment of a collapsible scent distributing airgun ("airgun") 10 may include a body 12 which in this form may be a pistol grip. As shown in FIG. 2, the body 12 may have first and second clamshell portions 14, 16 that may be held together in a closed position to define upper and lower seats 18, 20. By way of example, the first clamshell portion 14 may have a back surface 22 with a pair of hinge elements 24 and the second clamshell portion 16 may have aback surface 26 with a pair of hinge elements 28 that may be pivotally attached to the hinge elements 24 to permit the body 12 to move between open and closed positions. Further, the first clamshell portion 14 may have top and bottom surfaces 30, 32 that have a respective pair of snap-fit fasteners 34, 36 and the second clamshell portion 16 may have top and bottom surfaces 38, 40 that have a respective pair of snap-fit fasteners 42, 44, which may be attached to the snap-fit fasteners 34, 36 to hold the body 12 in the closed position. Of course, the body may instead have any number of portions that may be attached together by any suitable fasteners. In addition, the airgun 10 may include one or more partitions 46 that may be carried by the first and/or second clamshell portions 14, 16. The partitions 46 may be disposed between the upper and lower seats 18, 20 and also have an opening 48 through which the upper and lower seats 18, 20 may communicate with each other during assembly. In addition, each of the first and second clamshell portions 14, 16 may be made of plastic and have an inner surface 50 with a plurality of ribs 52 or webbing to reinforce a respective one of the clamshell portions 14, 16. Of course, the body may instead be made of metal or other nonplastic materials. The body 12 may also have a front surface 54 including an orifice 56 that may be communicated with the upper seat 18 during assembly. The orifice 56 in this form may be defined by a pair of notches 58, 60 formed in a respective one of the first and second clamshell portions 14, 16 and aligned together when the clamshell portions 14, 16 are moved to the closed position. The body 12 may also include a pivotal coupling 62, which in this form may be a pair of cantilevered arms 64 extending from the front surface 54 of the body 12. The pivotal coupling 62 may further include one or more guide members 66, such as a pair of tongues that may extend from a respective one of the cantilevered arms 64. Of course, the pivotal coupling and guide members may be any suitable pivoting fastener subassembly. The body 12 may further include a cam lock 68 or other fastener pivotally carried by the top surface 30 of the first clamshell portion 14. Moreover, the first and/or second clamshell portions 14, 16 may have a lateral surface 70 that may extend between the front and back surfaces 54, 26. Each lateral surface 70 may have an opening 71 that may be communicated with the lower seat 20.

The airgun 10 may also have a gas cartridge 72 that may be carried by the body 12. The gas cartridge 72 in this form may be received within the lower seat 20 of body 12. However, the gas cartridge 72 may be carried by any portion of the body 12. Further, the gas cartridge 72 may contain any amount of any suitable pressurized gas, such as 12 grams of carbon dioxide.

The airgun 10 may also have a pressure regulator valve 74 ("regulator"), which may be carried by the body 12 and communicated with the gas cartridge 72 to release gas from the cartridge 72 at a constant rate, despite the pressure in the cartridge decreasing as the airgun is being used. The regulator 74 in this form may be received within the upper seat 18 of body 12. Of course, the regulator 74, however, may be carried by any portion of the body 12. The regulator 74 may be a conventional pressure regulator and include a piercing valve 76, which may extend through opening 48 in the partition 46 and connect to the gas cartridge 72. Further, the regulator 74 may include an O-ring 78 sandwiched between the piercing valve 76 and the gas cartridge 72.

Figure 4:
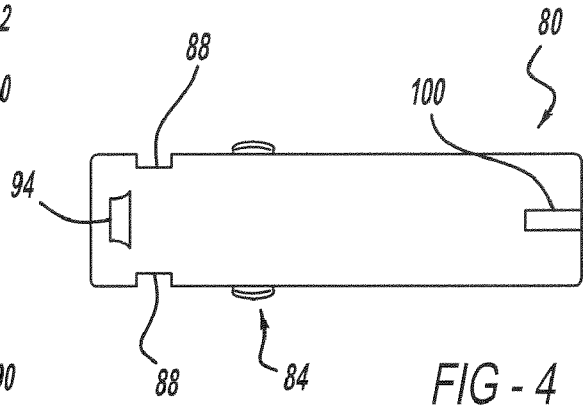
FIG. 4 is a top view of the barrel of FIG. 1.
Figure 5:
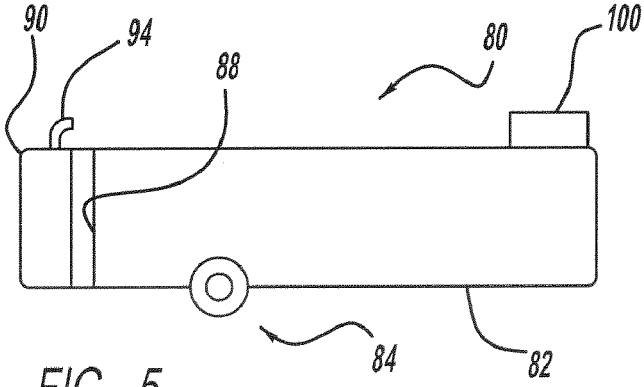
FIG. 5 is a side view of the barrel of FIG. 1.
Figure 6:
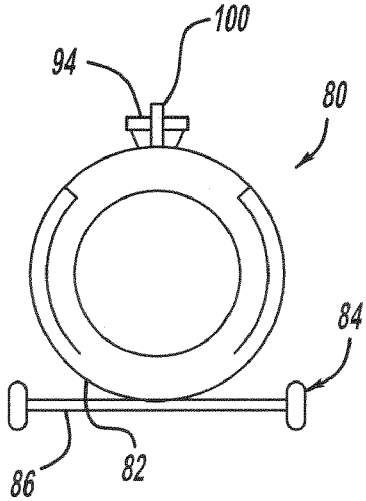
FIG. 6 is an end view of the barrel of FIG. 1.

The airgun 10 may also have a barrel 80 pivotally carried by the body 12 and movable by, for example, 90 degrees between an extended position (FIG. 1) and a collapsed position (FIG. 3). As best shown in FIGS. 4-6, the barrel 80 may have a bottom side 82 including a pivotal coupling 84 that may be fastened to the pivotal coupling 62 of the body 12. Of course, the pivotal coupling 84 may be carried by any portion of the barrel 80. As best shown in FIG. 6, the pivotal coupling 84 in this form may be a cross bar 86 having a middle portion coupled to the bottom side of the barrel 80 and extending transversely outward therefrom. The cross bar 86 may have a pair of opposing ends that may be pivotally carried by the cantilevered arms 64 of the body 12. Further, the barrel 80 may also have one or more guide members 88 that may be coupled to the guide members 66 of the body 12 to position an end 90 of the barrel 80 in the extended position so that an O-ring 92 may be sandwiched between the end 90 of the barrel 80 and the regulator 74 and further so that the barrel 80 may be communicated with the regulator 74 to receive pressurized gas therefrom. Each guide member 88 in this form may be a groove configured to receive a respective one of the tongues 66 on the body 12. In addition, the barrel 80 may also have a top surface 30 including a latch 94 or other fastener that may be coupled to the cam lock 68 carried by the body 12 to hold the barrel 80 in the extended position and further decrease leakage of gas.

Referring to FIG. 1, the airgun 10 may also have a laser sight 96 carried by the bottom side 82 of the barrel 80 or other suitable portion thereof. The laser sight 96 may be adapted to facilitate aiming the airgun 10 at a desired target. Of course, the barrel 80 may have a top side 98 with a front sight 100 mounted thereon, and the top surface 30 of the body 12 may have a rear sight 102 configured to align with the front sight 100 for aiming the airgun at the desired target.

Referring to FIG. 2, the airgun 10 may also have a trigger 104 pivotally carried by the body 12 and coupled to the regulator 74 to selectively direct the pressurized gas into the barrel 80 when the trigger 104 is moved to a pressed position. The airgun 10 may also have a biasing member 106, such as a torsional spring, that may be coupled to the trigger 104 to move the trigger to an unpressed position.

Figure 7:
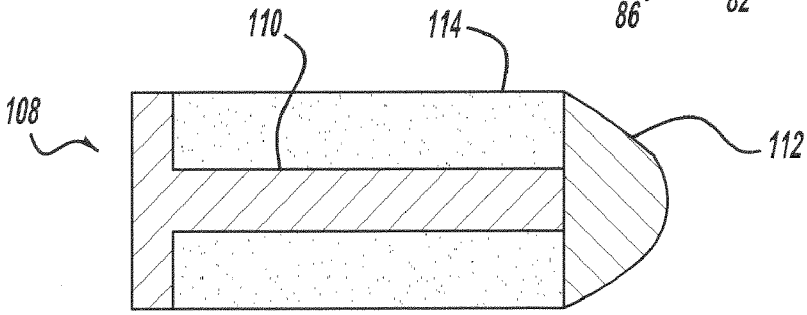
FIG. 7 is a cross-sectional view of the projectile of FIG. 3.

Referring now to FIG. 7, the airgun 10 may include a projectile 108 configured to emit a scent, such as deer musk, bear musk, doe urine, tarsal gland scent, acorn scent, apple scent or any other scent. The projectile 108 may have a shaft 110 terminating with a tapered head 112. The shaft 110 and tapered head 112 may be made of metal or other material having a predetermined weight to facilitate travel of the projectile 108 through the air. The projectile 108 may also have a scent carrier 114 mounted to the shaft 110. The scent carrier 114 may be a sponge, a cloth, a fabric, a fiber batting or other carrier having or adapted to have a liquid scent deposited thereon.

In use, the barrel 80 of the airgun 10 may be pivoted by, for example, 90 degrees from the extended position (FIG. 1) to the collapsed position (FIG. 3). Thereafter, the projectile 108 may be inserted into the end of the barrel 80, and a scent may be poured or otherwise deposited onto the scent carrier 114 of the projectile 108. Of course, the scent may instead have been previously applied to the projectile 108. The barrel 80 may then be returned to its extended position so that the guide members 66, 88 are engaged to each other to sandwich the O-ring 92 between the regulator 74 and the end 90 of barrel 80 thereby communicating the barrel 80 with the regulator 74, which is in turn communicated with the gas cartridge 72. In addition, the cam lock fastener 68 may be fastened to the latch 94 in a locked position to hold the barrel 80 in the extended position, facilitate compression of the O-ring and decrease leakage of gas between the regulator 74 and the barrel 80. The trigger 104 may be pressed or pulled to direct a predetermined amount of pressurized gas from the gas cartridge 72 through the regulator 74 and into the barrel 80 to launch the projectile 108 a somewhat consistent distance, such as 75 feet. In addition, ambient air may be drawn through the opening 48 in the lateral surface 70 of the body 12 to transfer heat to the cartridge 72 and regulator 74 and prevent the airgun 10 from freezing.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A collapsible scent distributing airgun, comprising:

a body;

a gas cartridge carried by the body and containing a pressurized gas;

a pressure regulator valve carried by the body and communicated with the gas cartridge;

a projectile that is configured to emit a scent;

a barrel pivotally carried by the body and movable between collapsed and extended positions, the barrel in the extended position having an end communicated with the pressure regulator valve to receive the pressurized gas, and the barrel in the collapsed position having the end adapted to receive said projectile that is configured to emit a scent; and a trigger pivotally carried by the body and coupled to the pressure regulator valve to selectively direct the pressurized gas into the barrel.

2. The collapsible scent distributing airgun of claim 1, wherein the barrel is configured to pivot 90 degrees between the extended and collapsed positions.

3. The collapsible scent distributing airgun of claim 1, wherein the body has at least one tongue, and the end of the barrel has at least one groove adapted to receive the at least one tongue when the barrel is moved to the extended position.

4. The collapsible scent distributing airgun of claim 1, further comprising a cam lock fastener carried by one of the body and the barrel to hold the barrel in the extended position.

5. The collapsible scent distributing airgun of claim 4, further comprising a latch carried by the other of the body and the barrel to fasten to the cam lock fastener.

6. The collapsible scent distributing airgun of claim 1, further comprising a laser sight carried by the barrel.

7. The collapsible scent distributing airgun of claim 1, further comprising at least one gun sight carried by at least one of the barrel and the body.

8. The collapsible scent distributing airgun of claim 1, wherein the projectile includes a shaft terminating with a tapered head, and the projectile also includes a scent carrier mounted to the shaft.

9. The collapsible scent distributing airgun of claim 8, wherein the scent carrier is one of a sponge, a cloth, and a fabric disposed about the shaft and adapted to have a liquid scent deposited thereon.

10. A method for operating a collapsible scent distributing airgun, comprising:

pivoting a barrel of the collapsible scent distributing airgun to a collapsed position;

depositing a scent onto a projectile;

inserting the projectile into the barrel;

pivoting the barrel to an extended position so that the barrel is communicated with a pressure regulator valve of the collapsible scent distributing airgun which is in turn communicated with a gas cartridge of the collapsible scent distributing airgun; and operating a trigger coupled to the pressure regulator valve to direct a predetermined amount of pressurized gas from the gas cartridge to the barrel to launch the projectile therefrom.

11. The method of claim 10, further comprising pivoting the barrel on a body of the collapsible scent distributing airgun 90 degrees between the extended and collapsed positions.

12. The method of claim 10, further comprising moving a cam lock fastener of the collapsible scent distributing airgun to a locked position to hold the barrel in the extended position.

13. The method of claim 12, further comprising moving the cam lock fastener carried by the body to a locked position so that the cam lock fastener fastens to a latch carried by the barrel.

14. A collapsible scent distributing airgun, comprising:

a body;

a gas cartridge carried by the body and containing a pressurized gas;

a pressure regulator valve carried by the body and communicated with the gas cartridge;

a barrel pivotally carried by the body and movable between collapsed and extended positions, the barrel in the extended position having an end communicated with the pressure regulator valve to receive the pressurized gas, and the barrel in the collapsed position having the end adapted to receive a projectile that is configured to emit a scent; and a trigger pivotally carried by the body and coupled to the pressure regulator valve to selectively direct the pressurized gas into the barrel, wherein the barrel is configured to pivot 90 degrees between the extended and collapsed positions.

15. A method for operating a collapsible scent distributing airgun, comprising:

pivoting a barrel of the collapsible scent distributing airgun to a collapsed position;

inserting a projectile configured to emit a scent into the barrel;

pivoting the barrel to an extended position so that the barrel is communicated with a pressure regulator valve of the collapsible scent distributing airgun which is in turn communicated with a gas cartridge of the collapsible scent distributing airgun; and operating a trigger coupled to the pressure regulator valve to direct a predetermined amount of pressurized gas from the gas cartridge to the barrel to launch the projectile therefrom.

* * * * *